US006402147B1

(12) United States Patent
Lo

(10) Patent No.: US 6,402,147 B1
(45) Date of Patent: Jun. 11, 2002

(54) CARD GAME

(76) Inventor: Henry T. Lo, 5070 River Glen Dr., Las Vegas, NV (US) 89103

( * ) Notice: Subject to any disclaimer, the term of this patent is extended or adjusted under 35 U.S.C. 154(b) by 0 days.

(21) Appl. No.: 09/315,295

(22) Filed: May 20, 1999

(51) Int. Cl.[7] ..... A63F 1/00
(52) U.S. Cl. ..... 273/292; 463/13
(58) Field of Search ..... 273/292, 274, 273/309; 463/10, 12, 13

(56) References Cited

U.S. PATENT DOCUMENTS 5,984,310 A * 11/1999 English ..... 273/292
6,019,374 A * 2/2000 Breeding ..... 273/292
6,102,402 A * 8/2000 Scott et al. ..... 273/292

* cited by examiner

*Primary Examiner*—Sam Rimell

(57) ABSTRACT

A seven-card-stud poker game, played by two to seven players with at least one standard poker deck of 52 cards plus at least one Joker. One of the players is the Banker. A Player who is not a Banker may play Poker Bet, playing against the Banker's hand and/or one to seven side bets betting on the contents of the Player's own hand. After a wager is placed, each Player and the Banker are each dealt seven cards. The Players and the Banker each then selects his best 5-card poker hand from his seven cards and discards two cards. To win a Poker Bet wager, a Player's best 5-card poker hand must rank higher than the Banker's best 5-card poker hand. To win a side-bet wager, a Player's best 5-card poker hand must be one of the predetermined winning hands of the type of the side bet he bets on. The Poker Bet wager and seven side-bet wagers are independent wagers and are settled separately.

22 Claims, 5 Drawing Sheets

7 CARD THRILL

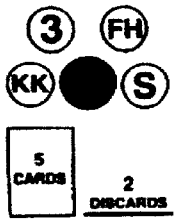

7 Card Thrill is a simplified version of Pai Gow Poker with 4 side bets, played with a traditional deck of 52 cards plus one Joker. The Joker can be used as an Ace, or to complete a Straight, Flush, Straight Flush or Royal Flush. Here, you are the Boss —you can choose to play either the poker bet against the Dealer's hand or the side bet(s) on the value of your own hand, or both, making from one to five bets at your choice.

● POKER BET

The object of the game is to have a best five-card poker hand that ranks higher than the Dealer's best five-card poker hand. Your best five-card poker hand which you selected from the seven cards dealt to you, is compared to the Dealer's best five-card poker hand according to traditional poker rankings:

| Rank | Hand |
|---|---|
| 1. | *5 Aces* |
| 2. | *Royal Flush* |
| 3. | *Straight Flush** |
| 4. | *4 of a Kind* |
| 5. | *Full House* |
| 6. | *Flush* |
| 7. | *Straight** |
| 8. | *3 of a Kind* |
| 9. | *Two Pair* |
| 10. | *One Pair* |
| 11. | *High Card* |

YOU WIN if your best five-card poker hand beats the Dealer's best five-card poker hand, and you will be paid even money (1 to 1) if the Dealer has King-Queen or better. *If the Dealer's losing hand does "not" have King-Queen or better, you will be paid half of your wager.* There is no 5% commission.

Same ranking hands push; no one wins or loses.

*A, 2, 3, 4, 5 is the second highest straight and second highest straight flush.

Fig.4

Page 2

SIDE BETS: KK 3 FH S

You bet on the value of your best five-card poker hand. Your wager wins if your hand has the type of hand you bet on, regardless of what the Dealer's hand is.

KK Pair Of Kings or Better Bet
Pair of *Aces* or *Better* pays 1 to 1.
Pair of *Kings* pays half of the wager.

3 3 Of A Kind or Better Bet
PAYS 4 to 1

FH Full House or Better Bet
PAYS 30 to 1

S Special Bet (is always $1)
*5 Aces*..... 10,000 to 1
*Royal Flush*..... 2,000 to 1 (Joker allowed)
*Straight Flush*..... 300 to 1 (Joker allowed)

If you want to play 7 Card Thrill, you must make either a ● or KK, or both. After you make at least one of these two bets, you may play 3, FH and/or S at your choice. GOOD LUCK!

In case your hand has more than one winning combination, only the highest combination will be paid for each bet.

FIVE STAR GAMING

FIVE STAR GAMING, Patent Pending. All Rights Reserved.

Fig. 5

CARD GAME

CROSS REFERENCE TO RELATED APPLICATIONS

This application claims priority under 35 U.S.C. §119(e) from the following U.S. provisional patent application: Application No. 60/086,110 filed May 20, 1998, which is hereby incorporated by reference.

A portion of the disclosure of this patent document contains material which is subject to copyright protection. The copyright owner has no objection to the facsimile reproduction by anyone of the patent disclosure, as it appears in the PTO patent file or records, but otherwise reserves all copyright rights whatsoever.

FIELD OF THE INVENTION

The present invention generally relates to card games and, in particular, to card games for use in casinos and cardrooms.

BRIEF DESCRIPTION OF THE DRAWINGS

FIGS. 4 and 5 show a rules card for a casino card game of the present invention.

SUMMARY

Figure 1:
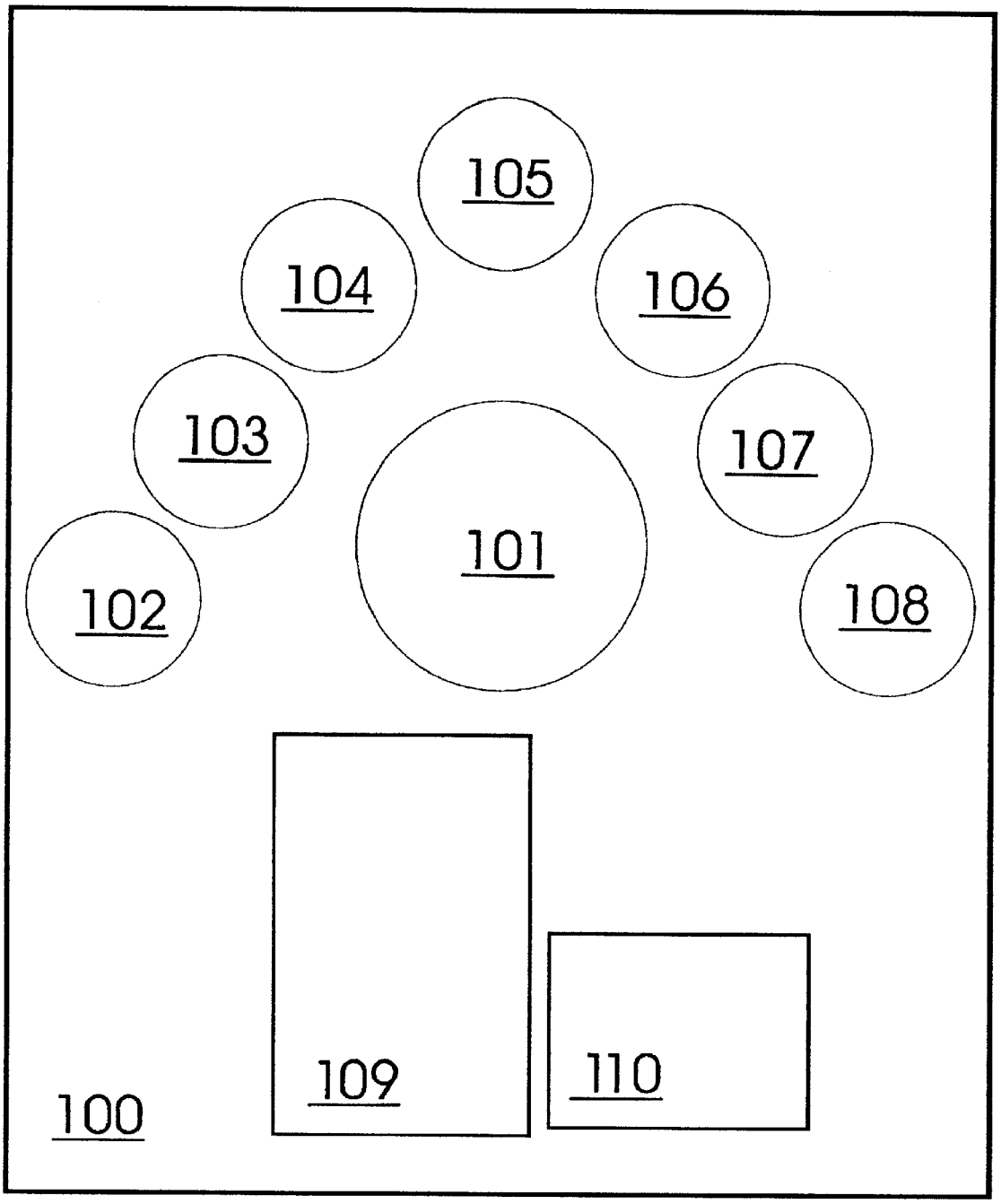
FIG. 1 shows a Player's betting area of the table layout of an eight-bet version of the invention.

The invention is a simplified version of Pai Gow Poker, a highly popular poker game. Both the present invention and Pai Gow Poker are a seven-card-stud poker game, played with one standard poker deck of 52 cards plus one "Joker." The Joker in both games can be used as an Ace or to form a Straight or Flush. Two or more players, preferably seven players, may participate in any given round of play. One of the players is the Banker whom other players play against.

The invention is considered a simplified version of Pai Gow Poker due to that in Pai Gow Poker, a dice shaker or a random number generator is used to assign dealt hands to players; seven hands of seven cards must be dealt in each round of play; each player must arrange his or her seven cards into two hands, a five-card high hand and a two-card low hand; there are more than one way to set a hand, thus, a certain level of skill is needed; a House-Banker's hand must be set according to a set of fixed rules known as house ways; to win, both of a Player's hands must beat both of the Banker's hands; the house charges a 5% commission on all winning wagers, thus, extra time is needed for a dealer to compute and collect the correct amount of commission on each winning wager. In the game of the invention, the game can be played without a dice shaker or a random number generator; the cards are dealt only to participating players, not into seven hands each round of play; only the best 5-card poker hand selected from each player's seven-card dealt hand play; there is only one way to set a hand, no skill and no house ways needed; to win, a Player's best 5-card poker hand must beat the Banker's best 5-card poker hand; the house does not charge a 5% commission on all winning wagers.

In the invention, a Player who is not a Banker may play Poker Bet (also called primary wager) playing against the Banker's hand and/or from one to seven side bets (also called secondary wagers) betting on the contents of the Player's own hand. After at least one wager is placed, each Player and the Banker are each dealt seven cards. From each Player's seven cards, each Player selects his or her best 5-card poker hand as his or her keeper hand and discards two other cards, which are treated as two discards; i.e., from the Player's seven dealt cards AAK9754, AAK97 is the Player's best 5-card poker hand and 54 are the two discards; from the Player's seven dealt cards QQJJ655, QQJJ6 is the Player's best 5-card poker hand and 55 are the two discards. From the Banker's seven cards, the Banker selects the Banker's best 5-card poker hand as the Banker's keeper hand and discards two other cards.

POKER BET is a bet that allows a Player to place a wager playing against the Banker's hand. The object of Poker bet is to have a best 5-card poker hand that outranks the Banker's best 5-card poker hand. In the Poker Bet game, the Player's best 5-card poker hand is compared to the Banker's best 5-card poker hand according to traditional poker rankings, wherein hands are ranked in descending order as follows: 5 Aces, Royal Flush, Straight Flush, 4 of a Kind, Full House, Flush, Straight, 3 of a Kind, Two Pair, One Pair and High Card. Ace is the highest High Card, following by King, Queen, Jack, Ten, 9, 8, 7, 6, 5, 4, 3 and 2. Ace, 2, 3, 4, 5 is the second highest Straight, behind AKQJ10 (Royal Flush).

A Poker Bet wager can preferably be settled with either one of the following rules, whichever is selected for the Poker Bet game:

Rules 1: If the Player's best 5-card poker hand ranks lower than the Banker's best 5-card poker hand, the Player's Poker Bet wager loses. If the Player's best 5-card poker hand ranks the same as the Banker's best 5-card poker hand, then the two hands tie and this wager neither wins nor loses. If the Player's best 5-card poker hand ranks higher than the Banker's best 5-card poker hand, this wager wins, and either is paid Even Money (1 to 1) if the Banker's losing hand is King-Queen or better, or is paid one half of the wager (1 to 2) if the Banker's losing hand is 'not' King-Queen or better.

Rules 2: If the Banker's best 5-card poker hand is 'not' one of predetermined qualifying hands such as King-high or better, Queen-high or better, Queen-Jack or better, Jack high or better, or etc., the Player Poker Bet wager is a tie. If the Player's best 5-card poker hand ranks lower than the Banker's and the Banker's best 5-card poker hand is one of the predetermined qualifying hands, this wager loses. If the Player's best 5-card poker hand ranks the same as the Banker's and the Banker's best 5-card poker hand is one of the predetermined qualifying hands, then two hands tie and this wager neither wins nor loses. If the Player's best 5-card poker hand ranks higher than the Banker's and the Banker's best 5-card poker hand is one of the predetermined qualifying hands, this wager wins and is paid Even Money (1 to 1).

Rules 3: If the Player's best 5-card poker hand ranks lower than the Banker's, this wager loses. If the Player's best 5-card poker hand ranks the same as the Banker's, then two hands tie and this wager neither wins nor loses. If the Player's best 5-card poker hand ranks higher than the Banker's, this wager wins and is paid Even Money (1 to 1), less a 5% commission.

Rules 4: If the Player's best 5-card poker hand ranks lower than or ranks the same as the Banker's, this wager loses. If the Player's best 5-card poker hand ranks higher than the Banker's, this wager wins and is paid Even Money (1 to 1).

The side bets are bets that allow Players to bet on the contents of their own hand. A Player's side-bet wager wins if the Player's best 5-card poker hand is one of the predetermined winning hands of the type of side bet he or she bets on, regardless of the outcome of the Poker Bet wager; and this wager loses if the Player's best 5-card poker hand is not one of the predetermined winning hands. The 7 side bets are Pair Of Kings Or Better Bet, Two Pair Or Better Bet, 3 Of A Kind Or Better Bet, Straight Or Better Bet, Flush Or Better Bet, Full House Or Better Bet and Bonus Bet.

PAIR OF KINGS OR BETTER BET: A Player's Pair Of Kings Or Better Bet wager wins if the Player's best 5-card poker hand is a pair of Kings, a pair of Aces, Two Pair, 3 of a Kind, Straight, Flush, Full House, 4 of a Kind, Straight Flush, Royal Flush or 5 Aces; and this wager loses if the Player's best 5-card poker hand is not one of the above winning hands. Pair Of Kings Or Better Bet pays one half of the wager (1 to 2) on a hand of a pair of Kings, and pays Even Money (1 to 1) on a hand of a pair of Aces or better; this payout odds yields a house advantage of 2.74%. Alternatively, any other appropriate payout odds can be used.

TWO PAIR OR BETTER BET: A Player's Two Pair Or Better Bet wager wins if the Player's best 5-card poker hand is Two Pair, 3 of a Kind, Straight, Flush, Full House, 4 of a Kind, Straight Flush, Royal Flush or 5 Aces; and this wager loses if the Player's best 5-card poker hand is not one of the above winning hands. Two Pair Or Better Bet pays 3 to 2 on any one of the above hands. Alternatively, any other appropriate payout odds can be used.

3 OF A KIND OR BETTER BET: A Player's 3 Of A Kind Or Better Bet wager wins if the Player's best 5-card poker hand is 3 of a Kind, Straight, Flush, Full House, 4 of a Kind, Straight Flush, Royal Flush or 5 Aces; and this wager loses if the Player's best 5-card poker hand is not one of the above winning hands. 3 Of A Kind Or Better Bet pays 4 to 1 on any one of the above hands; this payout odds yields a house advantage of 4.03%. Alternatively, any other appropriate payout odds can be used.

STRAIGHT OR BETTER BET: A Player's Straight Or Better Bet wager wins if the Player's best 5-card poker hand is Straight, Flush, Full House, 4 of a Kind, Straight Flush, Royal Flush or 5 Aces; and this wager loses if the Player's best 5-card poker hand is not one of the above winning hands. Straight Or Better Bet pays 4.5 to 1 on any one of the above hands. Alternatively, any other appropriate payout odds can be used.

FLUSH OR BETTER BET: A Player's Flush Or Better Bet wager wins if the Player's best 5-card poker hand is Flush, Full House, 4 of a Kind, Straight Flush, Royal Flush or 5 Aces; and this wager loses if the Player's best 5-card poker hand is not one of the above winning hands. Either one of two types of payouts below can be selected to be used for Flush Or Better Bet:

| [0022] | Payout 1: Hand | Payout Odds |
|---|---|---|
| | i. 5 Aces | 2,000 to 1 |
| | ii. Royal Flush | 500 to 1 |
| | iii. Straight Flush | 100 to 1 |
| | iv. 4 of a Kind | 30 to 1 |
| | v. Full House | 15 to 1 |
| | vi. Flush | 8 to 1 |

Payout 2: Flush Or Better Bet pays 12 to 1 on any one of the above winning hands.

Alternatively, any other appropriate payout odds can be used.

FULL HOUSE OR BETTER BET: A Player's Full House Or Better Bet wager wins if the Player's best 5-card poker hand is Full House, 4 of a Kind, Straight Flush, Royal Flush or 5 Aces; and this wager loses if the Player's best 5-card poker hand is not one of the above winning hands. Full House Or Better Bet pays 30 to 1 on any one of the above hands: this payout odds yields a house advantage of 5.31%. Alternatively, any other appropriate payout odds can be used.

BONUS BET: A Player's Bonus Bet wager wins if the Player's best 5-card poker hand is Straight Flush, Royal Flush or 5 Aces; and this wager loses if the Player's best 5-card poker hand is not one of the above winning hands. Either one of the two pay tables below can be used for Bonus Bet:

TABLE 1

(yielding a house advantage of 15.5%):

| Hand | Payout Odds |
|---|---|
| 5 Aces | 20,000 to 1 |
| Royal Flush | 2,000 to 1 |
| Straight Flush | 300 to 1 |

TABLE 2

(yielding a house advantage of 22.67%):

| Hand | Payout Odds |
|---|---|
| 5 Aces | 10,000 to 1 |
| Royal Flush | 2,000 to 1 |
| Straight Flush | 300 to 1 |

After at least one wager is placed, the cards are thoroughly shuffled either by a shuffling device or by a dealer, and are dealt into enough dealt hands of seven cards to provide a dealt hand for each Player and for the Banker. Once the dealer has delivered the cards to all players, the dealer turns over the Banker's seven cards face up with only the top card exposed. From each Player's own seven cards, each Player selects his or her best 5-card poker hand, discards two other cards, and places his or her cards face down on the appropriate spaces of the table layout. The dealer then reveals the Banker's six remaining cards, selects the Banker's best 5-card poker hand, discards two other cards, opens the cards of the Player at the immediate right of the dealer, and settles the Player's side-bet wager(s) first if any, and then the Player's Poker Bet wager if any, against the Banker.

DETAILED DESCRIPTION

A preferred embodiment of the invention provides a seven-card-stud poker game, played with one standard poker deck of 52 cards plus one Joker. Other embodiments include versions that would be played with two or more standard poker decks of 52 cards plus at least one Joker.

In this embodiment, the Joker is "semi-wild" and can be used as an Ace, or to form a Straight or Flush. In another embodiment, the Joker is "wild" and can be used as any card; this version alters the odds, the payout, and the house advantage of each type of bet of the version in the preferred embodiment, while it adds twelve (12) more rankings of 5 Deuces through 5 Kings to the ranking hands of the version in the preferred embodiment.

In this embodiment, two or up to seven players may participate in any given round of play, and one of them is the Banker whom other players play against. In other embodiments, two or up to the number of players where the cards are dealt into enough dealt hands of seven cards to provide a dealt hand for each Player and for the Banker, may participate in any given round of play.

A Player who is not a Banker may play Poker Bet playing against the Banker's hand and/or one or more side bets betting on the contents of the Player's own hand. After at least one of two wagers, a Poker Bet wager and Pair Of Kings Or Better Bet wager, is placed, each Player has the option to make one or more other side-bet wagers, then each Player and the Banker are each dealt seven cards. Once having delivered the cards to all players, the dealer turns over the Banker's seven cards with only the top card exposed. From each Player's own seven cards, each Player selects his or her best 5-card poker hand and discards two other cards, then each Player places his or her cards on the appropriate spaces of the table layout. The dealer then reveals the Banker's six remaining cards, selects the Banker's best 5-card poker hand, discards two other cards, settles each Player's side-bet wager(s) first if any, and then each Player's Poker Bet wager if any, against the Banker.

POKER BET: The object of Poker Bet is to have a best 5-card poker hand that outranks the Banker's best 5-card poker hand. In the Poker Bet game, a Player's best 5-card poker hand is compared to the Banker's best 5-card poker hand according to traditional poker rankings, where hands are ranked in descending order as follows: 5 Aces, Royal Flush, Straight Flush, 4 of a Kind, Full House, Flush, Straight, 3 of a Kind, Two Pair, One Pair and High Card. Ace is the highest High Card, following by King, Queen, Jack, Ten, 9, 8, 7, 6, 5, 4, 3 and 2.

In this embodiment, A2345 is the second highest Straight, behind AKQJ10. In another embodiment, A2345 is the lowest Straight, behind 65432. Changing the ranking of A2345 does not affect the odds of the game of the invention.

The Poker Bet wager may be settled with either one of the following embodiments, whichever is selected for the game.

In a preferred embodiment, if the Player's best 5-card poker hand ranks lower than the Banker's, the Player's Poker Bet wager loses. If the Player's and the Banker's best 5-card poker hand rank the same, then two hands tie and this wager neither wins nor loses. If the Player's hand ranks higher than the Banker's, this wager wins and either is paid Even Money (1 to 1) if the Banker's losing hand is King-Queen or better, or is paid one half of the wager (1 to 2) if the Banker's losing hand is not King-Queen or better.

In an embodiment, if the Banker's best 5-card poker hand is not one of a predetermined qualifying hands, such as a hand of King-high or better (i.e., a hand of KQ976 is a King-high hand and a hand of 22AQ8 is a better hand), a hand of Queen-high or better, a hand of Queen-Jack or better, a hand of Jack-high or better, or etc., the Player's Poker Bet wager is a tie and this wager neither wins nor loses. If the Player's best 5-card poker hand ranks lower than the Banker's and the Banker's best 5-card poker hand is one of predetermined qualifying hands, this wager loses. If the Player's best 5-card poker hand ranks the same as the Banker's and the Banker's best 5-card poker hand is one of the predetermined qualifying hands, then two hands tie and this wager neither wins nor loses. If the Player's best 5-card poker hand ranks higher than the Banker's and the Banker's best 5-card poker is one of the predetermined qualifying hands, this wager wins and is paid Even Money.

In another embodiment, If the Player's best 5-card poker hand ranks lower than the Banker's, the Player's Poker Bet wager loses. If the Player's best 5-card poker hand ranks the same as the Banker's, then two hands tie and this wager neither wins nor loses. If the Player's best 5-card poker hand ranks higher than the Banker's, this wager wins and is paid Even Money (1 to 1), less a 5% commission.

PAIR OF KINGS OR BETTER BET: A Player's Pair Of Kings Or Better Bet wager wins if the Player's best 5-card poker hand is a pair of Kings, a pair of Aces, Two Pair, 3 of a Kind, Straight, Flush, Full House, 4 of a Kind, Straight Flush, Royal Flush or 5 Aces; and this wager loses if the Player's best 5-card poker hand is not one of the above winning hands. In a preferred embodiment, Pair Of Kings Or Better Bet pays one half of the wager (1 to 2) on a hand of a pair of Kings, and pays Even Money (1 to 1) on a hand of a pair of Aces or better. In other embodiments, any other appropriate payout odds can be used.

TWO PAIR OR BETTER BET: A Player's Two Pair Or Better Bet wager wins if the Player's best 5-card poker hand is Two Pair, 3 of a Kind, Straight, Flush, Full House, 4 of a Kind, Straight Flush, Royal Flush or 5 Aces; and this wager loses if the Player's best 5-card poker hand is not one of the above winning hands. In an embodiment, Two Pair Or Better Bet pays 3 to 2 on any one of the above winning hands. In other embodiments, any other appropriate payout odds can be used.

3 OF A KIND OR BETTER BET: A Player's 3 Of A Kind Or Better Bet wager wins if the Player's best 5-card poker hand is 3 of a Kind, Straight, Flush, Full House, 4 of a Kind, Straight Flush or 5 Aces; and this wager loses if the Player's best 5-card poker hand is not one of the above winning hands. In a preferred embodiment, 3 Of A Kind Or Better Bet pays 4 to 1 on any one of the above winning hands. In other embodiments, any other appropriate payout odds can be used.

STRAIGHT OR BETTER BET: A Player's Straight Or Better Bet wager wins if the Player's best 5-card poker hand is Straight, Flush, Full House, 4 of a Kind, Straight Flush, Royal Flush or 5 Aces; and this wager loses if the Player's best 5-card poker hand is not one of the above winning hands. In an embodiment, Straight Or Better Bet pays 4.5 to 1 on any one of the above winning hands. In other embodiments, any other appropriate payout odds can be used.

FLUSH OR BETTER BET: A Player's Flush Or Better Bet wager wins if the Player's best 5-card poker hand is Flush, Full House, 4 of a Kind, Straight Flush, Royal Flush or 5 Aces; and this wager loses if the Player's best 5-card poker hand is not one of the above winning hands. In a preferred embodiment, this winning wager is paid according to the following pay table:

| a. Hand | Payout Odds |
|---|---|
| b. 5 Aces | 2,000 to 1 |
| c. Royal Flush | 500 to 1 |
| d. Straight Flush | 100 to 1 |
| e. 4 of a Kind | 30 to 1 |
| f. Full House | 15 to 1 |
| g. Flush | 8 to 1 |

In another preferred embodiment, Flush Or Better Bet pays 12 to 1 on any one of the above winning hands. In other embodiments, any other appropriate payout odds can be used.

FULL HOUSE OR BETTER BET: A Player's Full House Or Better Bet wager wins if the Player's best 5-card poker hand is Full House, 4 of a Kind, Straight Flush, Royal Flush or 5 Aces; and this wager loses if the Player's best 5-card poker hand is not one of the above winning hands. In a preferred embodiment, Full House Or Better Bet pays 30 to 1 on any one of the above winning hands. In other embodiments, any other appropriate payout odds can be used.

BONUS BET: A Player's Bonus Bet wager wins if the Player's best 5-card poker hand is Straight Flush, Royal Flush or 5 Aces; and this wager loses if the Player's best 5-card poker hand is not one of the above winning hands. In a preferred embodiment, Bonus Bet pays 20,000 to 1 on a hand of 5 Aces, 2,000 to 1 on a hand of Royal Flush, and 300 to 1 on a hand of Straight Flush. In an embodiment, Bonus Bet pays 10,000 to 1 on a hand of 5 Aces, 2,000 to 1 on a hand of Royal Flush, and 300 to 1 on a hand of Straight Flush.

The Deal

In the most preferred embodiment, the invention uses a standard poker deck of 52 cards plus one Joker. In other embodiments, the invention uses at least one standard poker deck of 52 cards plus at least one Joker.

In this embodiment, the invention offers seven positions. Table size, management of players, the number of players' bets, and speed of play are the key reasons for the choice of seven positions. In other embodiments, lesser or greater than seven positions can be created in accordance with this invention if, for example, multiple decks are used.

In this embodiment, each Player receives his or her own seven-card dealt hand, and the Banker receives his or her own seven-card dealt hand, starting from the Player sitting to the immediate left of the dealer, continuing in a clockwise fashion and ending with the Banker. Cards are preferably dealt to each Player and to the Banker one card at a time for seven times if the cards are shuffled by a dealer; the cards are preferably dealt to each Player and to the Banker in a stack of seven cards if the cards are shuffled by a shuffling device. In another embodiment, seven hands of seven cards are always dealt, regardless of the actual number of players; and some random number generation device such as a random number generator or a dice shaker, is used to assign the dealt hands to players to reduce the likelihood of problems in dealing, in other embodiments, other traditional methods used in other poker games may be used for the deal.

After at least one wager is placed, the cards are thoroughly shuffled either by a shuffling device or by a dealer, and they are dealt into enough dealt hands of seven cards to provide a dealt hand for each Player and for the Banker. Once the dealer has delivered the cards to all players, the dealer turns over the Banker's seven cards face up with only the top card exposed. Each Player then selects his or her best 5-card poker hand, discards two other cards, and places the cards face down on the appropriate spaces of the table layout. The dealer then reveals the Banker's six remaining cards, selects the Banker's best 5-card poker hand, discards two other cards, opens the cards of the Player at the immediate right of the dealer, and settles the Player's side-bet wager(s) first if any, and then the Player's Poker Bet wager if any, against the Banker. After completing the transaction of the Player at the immediate right of the dealer, the dealer moves on and completes the transaction of the next Player, and so on. Upon the completion of all transactions, a new round of play will begin.

Tables For Use In Play

Figure 2:
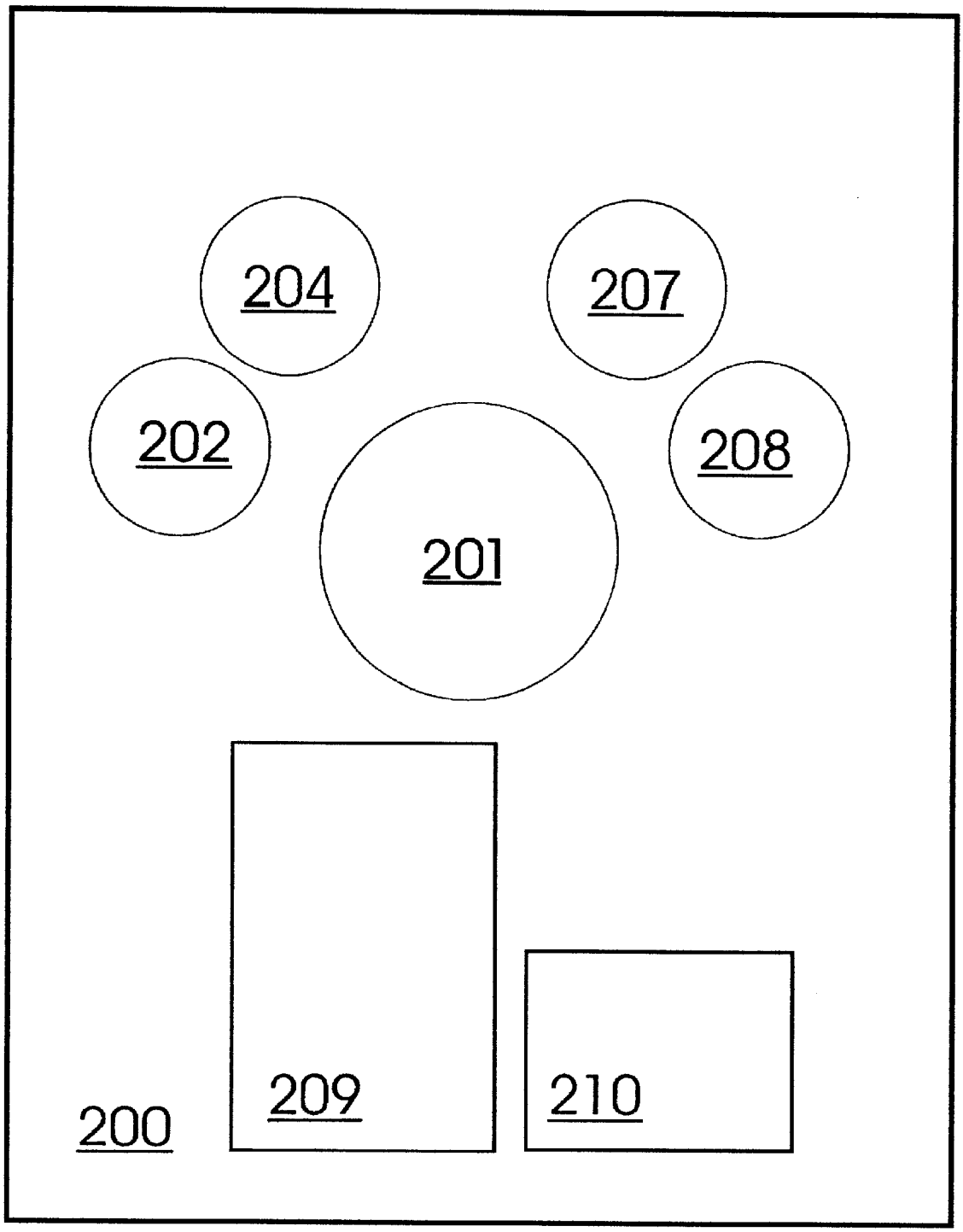
FIG. 2 shows a Player's betting area of the table layout of a five-bet version of the invention.
Figure 3:
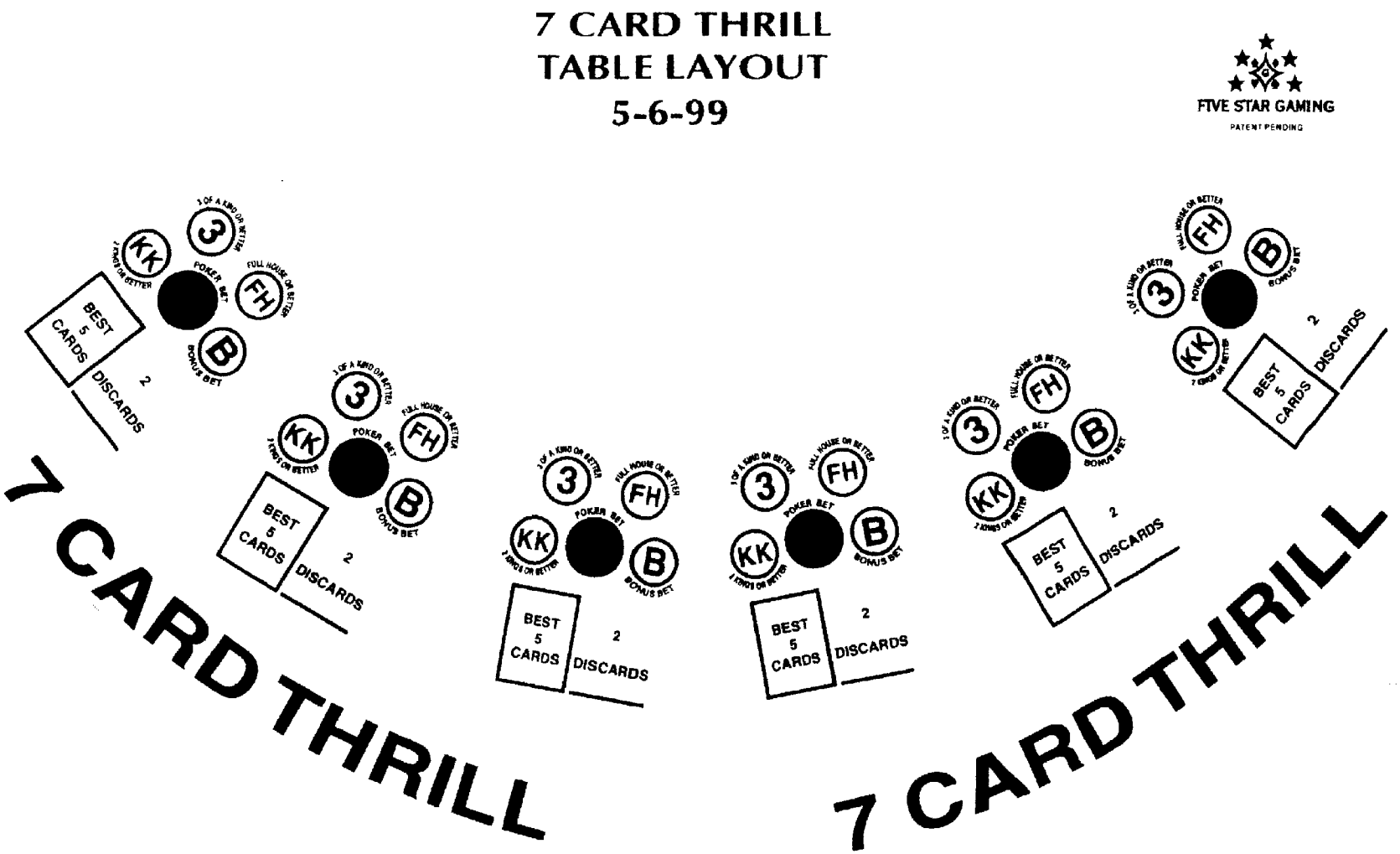
FIG. 3 shows a preferred table layout of a casino card game of the present invention in accordance with FIG. 2.

Play may be facilitated by using tables configured and marked as shown in FIGS. 1 through 3. Referring now to FIG. 1 it shows a portion of a casino table as used for betting. Each Player is provided with a Player area 100. In this embodiment of the invention, a Player first places a Poker Bet wager n the Poker Bet spot 101, a Pair Of Kings Or Better Bet wager in spot 102 or wagers in both spots 101 and 102. After the player has placed one or both of those wagers, the player may place one or more side-bet wagers or secondary wagers in other spots: Two Pair Or Better Bet spot 103, 3 Of A Kind Or Better Bet spot 104, Straight Or Better Bet spot 105, Flush Or Better Bet spot 106, Full House Or Better Bet spot 107, Bonus Bet spot 108. Hands are dealt to each Player. Each Player then places his or her best 5-card poker hand in the Player's best 5-card poker hand space 109 and discards two other cards from his or her hand to the Player's two discards space 110.

FIG. 2 shows a portion of a different casino table as used for betting. Each Player is provided with a Player area 200. In this embodiment, a Player first places a Poker Bet wager n the Poker Bet spot 201, Pair of Kings or Better Bet wager in spot 202 or wagers in both spots 201 and 202. After the player has placed one or both of those wagers, the player may place one or more side-bet wagers in the other spots: 3 Of A Kind Or Better Bet spot 204; Full House Or Better Bet spot 207; Bonus Bet spot 208. Hands are dealt to each Player. Each Player then places his or her best 5-card poker hand in the best 5-card poker hand space 209 and discards two other cards from his or her hand to the two discards space 210.

FIG. 3 shows a portion of a full gaming table with similar Player areas 200 as shown in FIG. 2.

FIGS. 4 and 5 show a copy of a rules card for use with a particular implementation of the game of the present invention. This implementation has: a semi-wild joker; bets for Pair Of Kings Or Better, Three-Of-A-Kind, Full House Or Better, and Special or Bonus betting; "King-Queen qualifying hand" rule, including half-payment when the player wins and the dealer has a non-qualifying hand; same ranking hands push; and the A, 2, 3, 4, 5 Straight is the second highest Straight.

Other appropriate playing surfaces may be used in connection with the card game of the present invention.

Wagers are placed with money or chips representing money or other means used in the art.

Having thus described the invention, what is claimed is:

1. A method of playing a card game among a plurality of Players and a Banker, each Player wagering against the Banker, the method comprising the following steps:

providing and shuffling at least one standard poker deck of 52 cards plus at least one Joker;

at least one Player placing at least a Poker Bet wager and optionally a Pair Of Kings Or Better Bet wager, each Player having an option to place one or more wagers on the other side bets:

Two Pair Or Better Bet, 3 Of A Kind Or Better Bet, Straight Or Better Bet, Flush Or Better Bet, Full House Or Better Bet and Bonus Bet;

dealing cards into enough dealt hands of seven cards to provide a dealt hand for each Player and for the Banker;

determining which dealt hand is assigned to each Player and which dealt hand is assigned to the Banker;

from their own seven-card dealt hand, each Player and the Banker selecting their own best 5-card poker hand and discarding two other cards;

determining whether each Player's side-bet wager or wagers, if any, wins, or loses;

settling any side-bet wagers of each Player against the Banker;

comparing each Player's best 5-card poker hand to the Banker's best 5-card poker hand according to a ranking selected for the Poker Bet game wherein hands are ranked in descending order as follows:

5 Aces, Royal Flush, Straight Flush, 4 of a Kind, Full House, Flush, Straight, 3 of a Kind, Two Pair, One Pair and High Card; wherein Ace is the highest High Card, following by King, Queen, Jack, Ten, 9, 8, 7, 6, 5, 4, 3 and 2;

determining whether each Player's Poker Bet wager, if any, wins, loses or ties; and settling each Player's Poker Bet wager against the Banker.

2. The method of playing a card game according to claim 1, wherein the ranking selected for the Poker Bet game further provides that A2345 is the second highest Straight and that when it is suited, A2345 is the second highest Straight Flush.

3. The method of playing a card game according to claim 1, wherein the ranking selected for the Poker Bet game further provides that A2345 is the lowest Straight and that when it is suited, A2345 is the lowest Straight Flush.

4. The method of playing a card game according to claim 1, wherein the cardgame uses one standard poker deck of 52 cards plus one Joker.

5. The method of playing a card game according to claim 1, wherein the Joker may be used as an Ace, or to form a Straight or Flush.

6. The method of playing a card game according to claim 1, wherein a Player's Pair Of Kings Or Better Bet wager wins if the Player's best 5-card poker hand is a pair of Kings, a pair of Aces, Two Pair, 3 of a Kind, Straight, Flush, Full House, 4 of a Kind, Straight Flush, Royal Flush or 5 Aces; and this wager loses if the Player's best 5-card poker hand is not one of the aforesaid winning hands.

7. The method of playing a card game according to claim 6, wherein Pair Of Kings Or Better Bet pays one half of the wager, namely 1 to 2, on a hand of a pair of Kings, and pays Even Money, namely 1 to 1, on a hand of a pair of Aces or better.

8. The method of playing a card game according to claim 1, wherein a Player's Two Pair Or Better Bet wager wins if the Player's best 5-card poker hand is Two Pair, 3 of a Kind, Straight, Flush, Full House, 4 of a Kind, Straight Flush, Royal Flush or 5 Aces; and this wager loses if the Player's best 5-card poker hand is not one of the aforesaid winning hands.

9. The method of playing a card game according to claim 1, wherein a Player's 3 Of A Kind Or Better Bet wager wins if the Player's best 5-card poker hand is 3 of a Kind, Straight, Flush, Full House, 4 of a Kind, Straight Flush, Royal Flush or 5 Aces; and this wager loses if the Player's best 5-card poker hand is not one of the aforesaid winning hands.

10. The method of playing a card game according to claim 9, wherein 3 Of A Kind Or Better Bet pays 4 to 1 on a hand of 3 of a Kind, Straight, Flush, Full House, 4 of a Kind, Straight Flush, Royal Flush or 5 Aces.

11. The method of playing a card game according to claim 1, wherein a Player's Straight Or Better Bet wager wins if a Player's best 5-card poker hand is Straight, Flush, Full House, 4 of a Kind, Straight Flush, Royal Flush or 5 Aces; and this wager loses if the Player's best 5-card poker hand is not one of the aforesaid winning hands.

12. The method of playing a card game according to claim 11, wherein Straight Or Better Bet pays 4.5 to 1 on a hand of Straight, Flush, Full House, 4 of a Kind, Straight Flush, Royal Flush or 5 Aces.

13. The method of playing a card game according to claim 11, wherein a Player's Flush Or Better Bet wager wins if the Player's best 5-card poker hand is Flush, Full House, 4 of a Kind, Straight Flush, Royal Flush or 5 Aces; and this wager loses if the Player's best 5-card poker hand is not one of the aforesaid winning hands.

14. The method of playing a card game according to claim 13, wherein Flush Or Better Bet wager pays 2,000 to 1 on a hand of 5 Aces, 500 to 1 on a hand of Royal Flush, 100 to 1 on a hand of Straight Flush, 30 to 1 on a hand of 4 of a Kind, 15 to 1 on a hand of Full House, and 8 to 1 on a hand of Flush.

15. The method of playing a card game according to claim 13, wherein Flush Or Better Bet wager pays 12 to 1 on a hand of Flush, Full House, 4 of a Kind, Straight Flush, Royal Flush or 5 Aces.

16. The method of playing a card game according to claim 1, wherein a Player's Full House Or Better Bet wager wins if the Player's best 5-card poker hand is Full House, 4 of a Kind, Straight Flush, Royal Flush or 5 Aces; and this wager loses if the Player's best 5-card poker hand is not one of the aforesaid winning hands.

17. The method of playing a card game according to claim 16, wherein Full House Or Better Bet pays 30 to 1 on a hand of Full House, 4 of a Kind, Straight Flush, Royal Flush or 5 Aces.

18. The method of playing a card game according to claim 1, wherein a Player's Poker Bet wager is settled against the Banker as follows:

If the Player's best 5-card poker hand ranks lower than the Banker's, the Player's Poker Bet wager loses;

If the Player's best 5-card poker hand ranks the same as the Banker's, then two hands tie and this wager neither wins nor loses; and If the Player's best 5-card poker hand ranks higher than the Banker's, this wager wins, and either is paid Even Money, namely 1 to 1, if the Banker's losing hand is King-Queen or better, or is paid one half of the wager, namely 1 to 2, if the Banker's losing hand is not King-Queen or better.

19. The method of playing a card game according to claim 1, wherein a Player's Poker Bet wager is settled against the Banker as follows:

If the Player's best 5-card poker hand ranks lower than the Banker's, the Player's Poker Bet wager loses;

If the Player's best 5-card poker hand ranks the same as the Banker's, then two hands tie and this wager neither wins nor loses; and If the Player's best 5-card poker hand ranks higher than the Banker's, this wager wins and is paid Even Money, namely 1 to 1, less a 5% commission.

20. The method of playing a card game according to claim 11, wherein a Player's Poker Bet wager is settled against the Banker as follows:

If the Banker's best 5-card poker hand is not one of the predetermined qualifying hands, the Player's Poker Bet wager is a tie and it neither wins nor loses;

If the Player's best 5-card poker hand ranks lower than the Banker's and the Banker's best 5-card poker hand is one of the predetermined qualifying hands, then this wager loses;

If the Player's best 5-card poker hand ranks the same as the Banker's and the Banker's best 5-card poker hand is one of the predetermined qualifying hands, then two hands tie and this wager neither wins nor loses; and If the Player's best 5-card poker hand ranks higher than the Banker's and the Banker's best 5-card poker hand is one of the predetermined qualifying hands, this wager wins and is paid Even Money, namely 1 to 1.

21. The method of playing a card game according to claim 20, wherein a Player's Poker Bet wager is settled against the Banker as follows:

If the Banker's best 5-card poker hand is not a qualifying hand of Queen-Jack or better, the Player's Poker Bet wager is a tie and it neither wins nor loses;

If the Player's best 5-card poker hand ranks lower than the Banker's and the Banker's best 5-card poker hand is a qualifying hand of Queen-Jack or better, this wager loses;

If the Player's best 5-card poker hand ranks the same as the Banker's and the Banker's best 5-card poker hand is a qualifying hand of Queen-Jack or better, the two hands tie and this wager neither wins nor loses; and If the Player's best 5-card poker hand ranks higher than the Banker's and the Banker's best 5-card poker hand is a qualifying hand of Queen-Jack or better, this wager wins and is paid Even Money, namely 1 to 1.

22. The method of playing a card game according to claim 1, wherein the Joker may be used as any card.

* * * * *